US007337737B1

(12) United States Patent
Fanucci et al.

(10) Patent No.: US 7,337,737 B1
(45) Date of Patent: Mar. 4, 2008

(54) STANCHION ASSEMBLY

(75) Inventors: Jerome P. Fanucci, Lexington, MA (US); Michael McAleenan, Georgetown, ME (US); Kirk E. Survilas, Peabody, MA (US)

(73) Assignee: Kazak Composites, Incorporated, Woburn, MA (US)

( * ) Notice: Subject to any disclaimer, the term of this patent is extended or adjusted under 35 U.S.C. 154(b) by 0 days.

(21) Appl. No.: 11/452,132

(22) Filed: Jun. 13, 2006

Related U.S. Application Data

(60) Provisional application No. 60/725,272, filed on Oct. 11, 2005, provisional application No. 60/690,101, filed on Jun. 13, 2005.

(51) Int. Cl.
*B63B 25/08* (2006.01)

(52) U.S. Cl. ..... 114/75; 410/149

(58) Field of Classification Search ..... 114/75; 410/151, 153, 144, 145, 146, 149
See application file for complete search history.

(56) References Cited

U.S. PATENT DOCUMENTS 3,062,157 A * 11/1962 Woods ..... 410/149
3,836,174 A * 9/1974 Holman, Jr. ..... 410/149
5,104,269 A * 4/1992 Hardison ..... 410/149
5,944,464 A * 8/1999 Cole, Jr. ..... 410/153
6,626,624 B1 * 9/2003 Kopperud ..... 410/129

* cited by examiner

*Primary Examiner*—Ed Swinehart
(74) *Attorney, Agent, or Firm*—Weingarten, Schurgin, Gagnebin & Lebovici LLP

(57) ABSTRACT

A stanchion assembly is provided for retaining cargo in a hold from lateral motion, the hold having a deck grid fitting assembly and a ceiling grid fitting assembly. The stanchion assembly includes an elongated beam with a box cross section of two parallel webs and two parallel flanges. The beam is an extrusion of an aluminum or aluminum alloy. The assembly includes upper and lower end caps on the ends of the beam. A spring assembly within the elongated box beam retains the beam in a vertical position within the corresponding fitting on the grid assembly on the deck and the ceiling. The stanchion assembly has a weight no greater than 67 pounds. The stanchion assembly has a length L in the longitudinal direction from a lower end cap to an upper end cap when the spring assembly is uncompressed. The beam has a stiffness capable of resisting a design load applied to one of the webs normal to the longitudinal direction with a deflection no greater than L/90.

11 Claims, 3 Drawing Sheets

STANCHION ASSEMBLY

CROSS REFERENCE TO RELATED APPLICATIONS

This application claims the benefit under 35 U.S.C. §119 (e) of U.S. Provisional Patent Application No. 60/690,101, filed on Jun. 13, 2005, and U.S. Provisional Patent Application No. 60/725,272, filed on Oct. 11, 2005, the disclosures of both of which are incorporated by reference herein.

STATEMENT REGARDING FEDERALLY SPONSORED RESEARCH OR DEVELOPMENT

N/A

BACKGROUND OF THE INVENTION

It is known to restrain cargo in the holds of ships using vertical stanchions that abut against stacked cargo pallets and other loads to keep these items from shifting laterally. Such a stanchion extends from floor to ceiling and includes floor and ceiling end caps that mate with corresponding fittings disposed, typically in a grid arrangement, on the floor and the ceiling of the cargo hold. A spring assembly within the stanchion allows the length to be temporarily reduced during the installation process, then extended to bias the end caps into the fittings, thereby locking the stanchion in place.

The stanchions must be able to withstand substantial horizontally applied loads from the cargo, which may shift during transit. Prior art metal stanchions that can withstand these loads with an acceptably minimal deflection have an I-beam or circular configuration in cross-section, but are prohibitively heavy. To reduce weight, hybrid stanchions made of a metal and a composite material have been used for this application.

SUMMARY OF THE INVENTION

The present invention provides a metal stanchion assembly for specific combinations of stanchion loading, stanchion length, desired stanchion weight and maximum deflection under load. The present invention provides a stanchion assembly comprising an all-metal box beam extrusion in combination with upper and lower deck fittings that is capable of withstanding certain horizontal loads from cargo in a ship without excessive weight. The box beam provides a durable, fire-resistant lightweight and cost effective element for the main body of the stanchion assembly.

More particularly, the stanchion assembly comprises an elongated box beam having two parallel webs and two parallel flanges. Upper and lower end caps allow the stanchion assembly to fit into grid assemblies on a deck and ceiling or other arrangements shaped to accept mating features on each end of the stanchion. A spring assembly biases one of the end caps outwardly to retain the stanchion assembly vertically in place.

In one embodiment, the stanchion assembly has a weight no greater than 65 pounds, preferably no greater than 60 pounds. In another embodiment, the stanchion has a weight no greater than 70 pounds and preferably no greater than 66 pounds. The stanchion assembly has a stiffness capable of resisting a maximum design load applied to one of the webs normal to the longitudinal direction with a deflection no greater than L/90, where L is the length of the stanchion assembly between a lower end cap and an upper end cap when the spring assembly is uncompressed. The length L is typically between 7 and 12 feet, and preferably between 8 and 11 feet. The stanchion assembly preferably can exhibit a larger deflection at twice the design load but return elastically to its original shape with no permanent damage.

DESCRIPTION OF THE DRAWINGS

The invention will be more fully understood from the following detailed description taken in conjunction with the accompanying drawing in which.

DETAILED DESCRIPTION OF THE INVENTION

Figure 1:
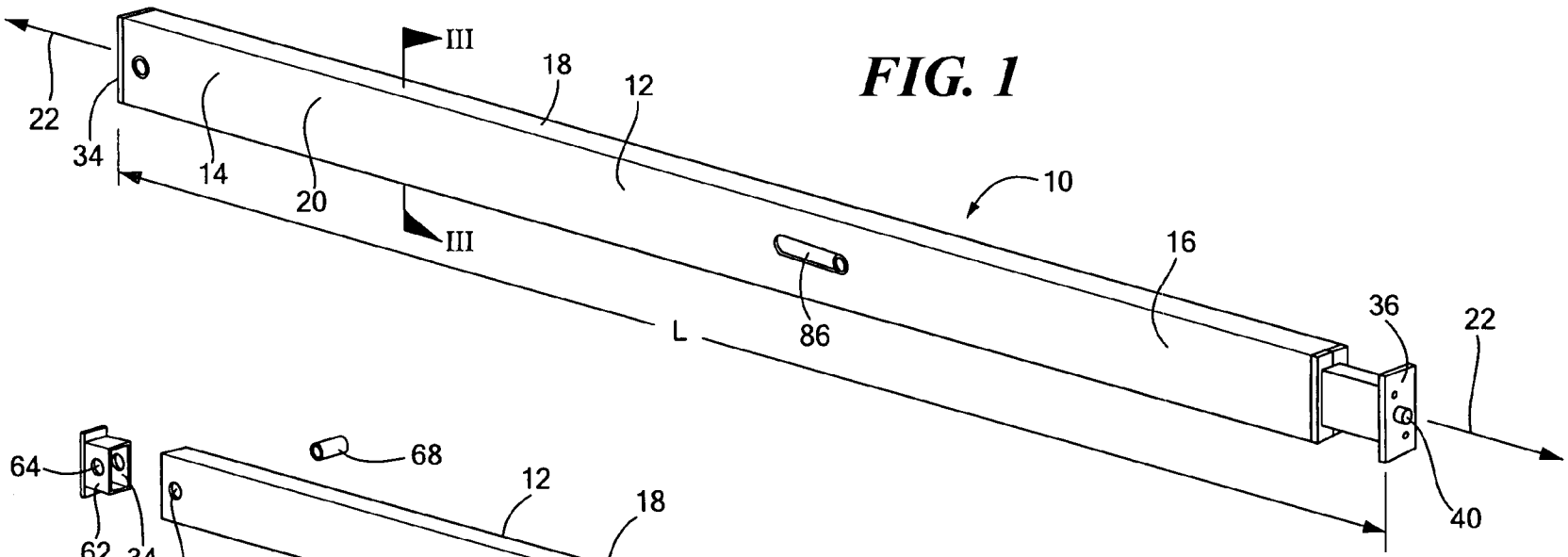
FIG. 1 is an isometric view of a stanchion assembly of the present invention.
Figure 2:
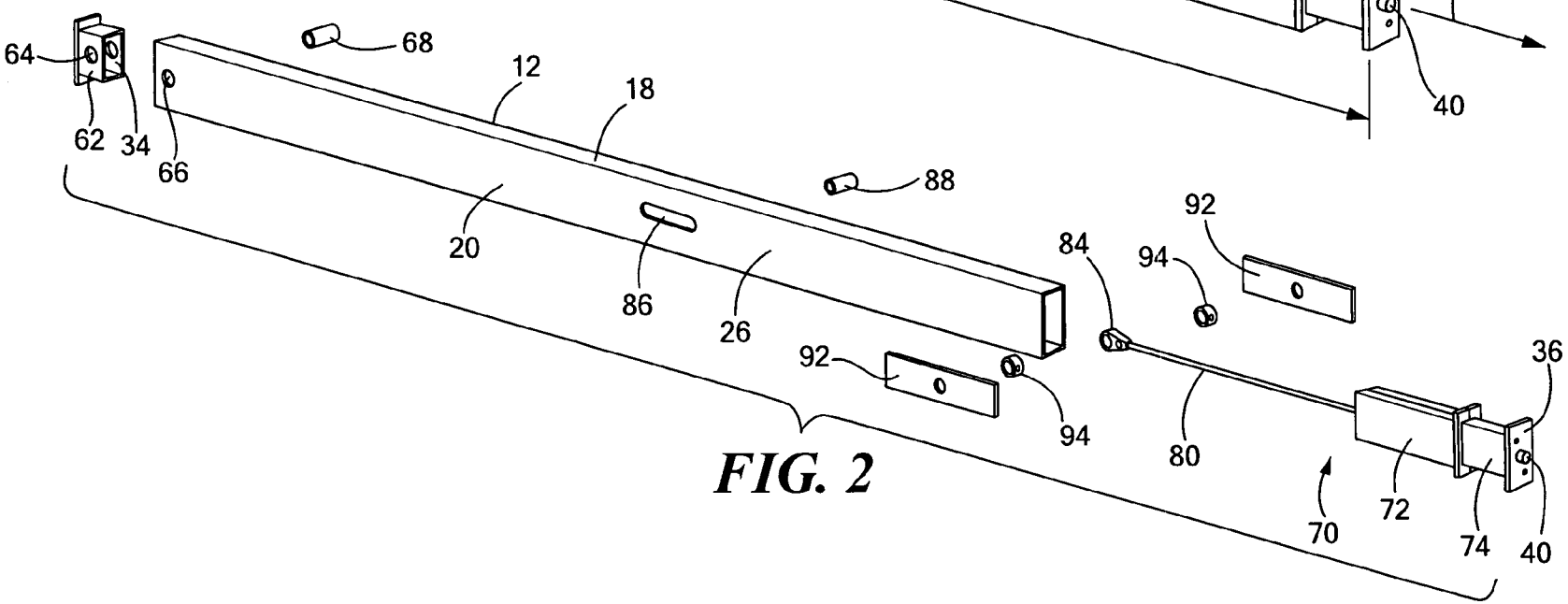
FIG. 2 is an exploded view of the stanchion assembly of FIG. 1.
Figure 3:
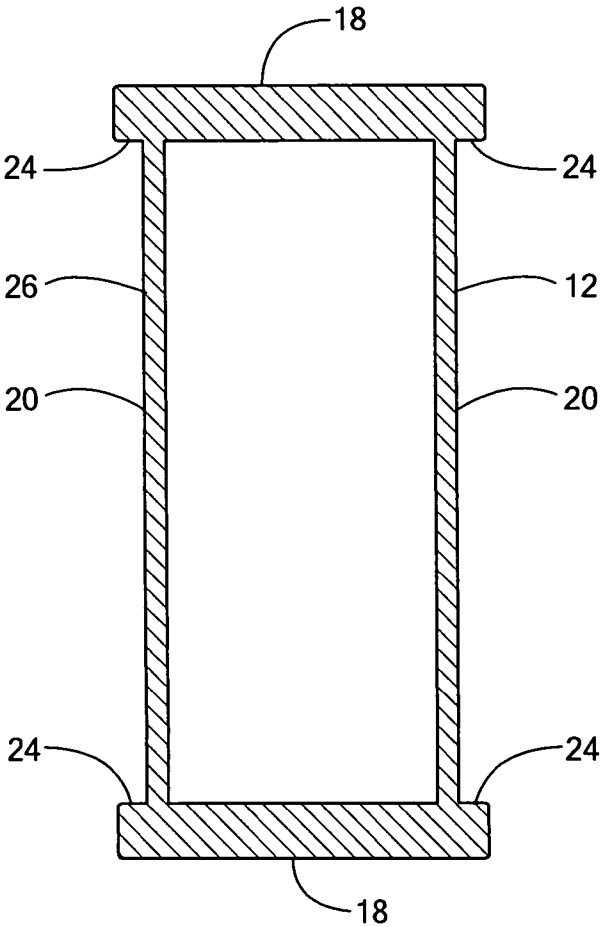
FIG. 3 is a cross-sectional view taken along line III-III of FIG. 1.

Referring to FIGS. 1 and 2, a stanchion assembly 10 of the present invention employs an all-metal elongated beam 12 comprising an extrusion 26 extending in a longitudinal direction between a first or lower end 14 and a second or upper end 16. The beam has a box beam or box-and-I beam configuration. In the embodiment illustrated, the stanchion assembly beam comprises two parallel webs 18 and two parallel flanges 20 when viewed in a cross-section taken along a plane transverse to the longitudinal axis of the beam. See FIG. 3. The webs and flanges extend longitudinally and parallel to the beam's longitudinal axis 22 between the lower end and the upper end. Preferably, the web ends overhang the flanges by a small amount to provide gripping edges 24 for a user's fingers when lifting, carrying, and setting the stanchion in place. The overhanging web ends can also be used for attachment and nailing in some applications. The beam extrusion may further be machined to provide a desired configuration or feature.

In one embodiment, the stanchion assembly 10 has a weight no greater than 65 pounds, preferably no greater than 60 pounds, and most preferably no greater than 50 pounds. The beam 12 has a stiffness capable of resisting a maximum design load applied on a web 18 normal to the longitudinal axis 22 with a peak deflection at the design load no greater than L/90. L is the length of the stanchion assembly in an uncompressed configuration from a lower end cap 34 to an upper end cap 36, not including protrusions (described further below). In the uncompressed configuration, the spring assembly extends generally about six inches from the end of the beam. The load can be distributed over a portion or all of the beam or can be applied at one or more discrete points. Also, the stanchion assembly preferably can exhibit a larger deflection at twice the design load but return elastically to its original shape with no permanent damage. That is, the beam can resist a load of twice the design load without permanent deformation from yielding. At three times the design load, the stanchion assembly preferably does not collapse, but it can sustain some damage.

For some applications, it may be desirable to have a beam with a longer length, such as 11 feet. Also, it may be desirable to increase the length of the gripping edges 24 to ¾ or 1 inch, for example, so that nails can be bent around the edges 24 to assist in retaining the stanchions in place. In this case, the weight limit may be increased to a maximum of 70 pounds, and preferably no greater than 66 pounds.

To keep the weight of the stanchion assembly no greater than 65 pounds, or 70 pounds, depending on the embodiment, the beam extrusion is comprised of a metal such as an aluminum or aluminum alloy. Suitable aluminum metals include 6061-T6 and 6005-T5, although other aluminum metals can be used, as could be determined by one of skill in the art. The aluminum can be anodized to reduce corrosion. The anodized coating type and thickness depend on the selected corrosion standards. The anodized coating can also be colored to enhance identification of beams of different sizes and/or load bearing capacities.

Figure 4:
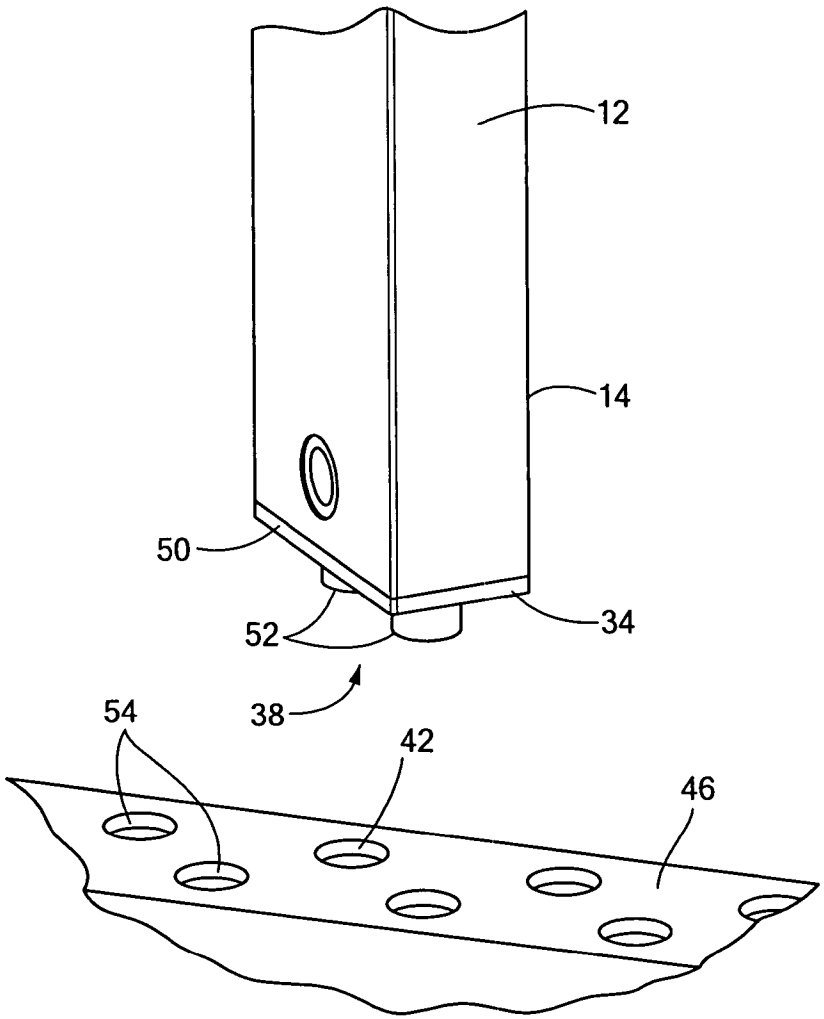
FIG. 4 is an exploded view of the lower end of the stanchion assembly of FIG. 1 and corresponding fitting on a deck or floor.
Figure 5:
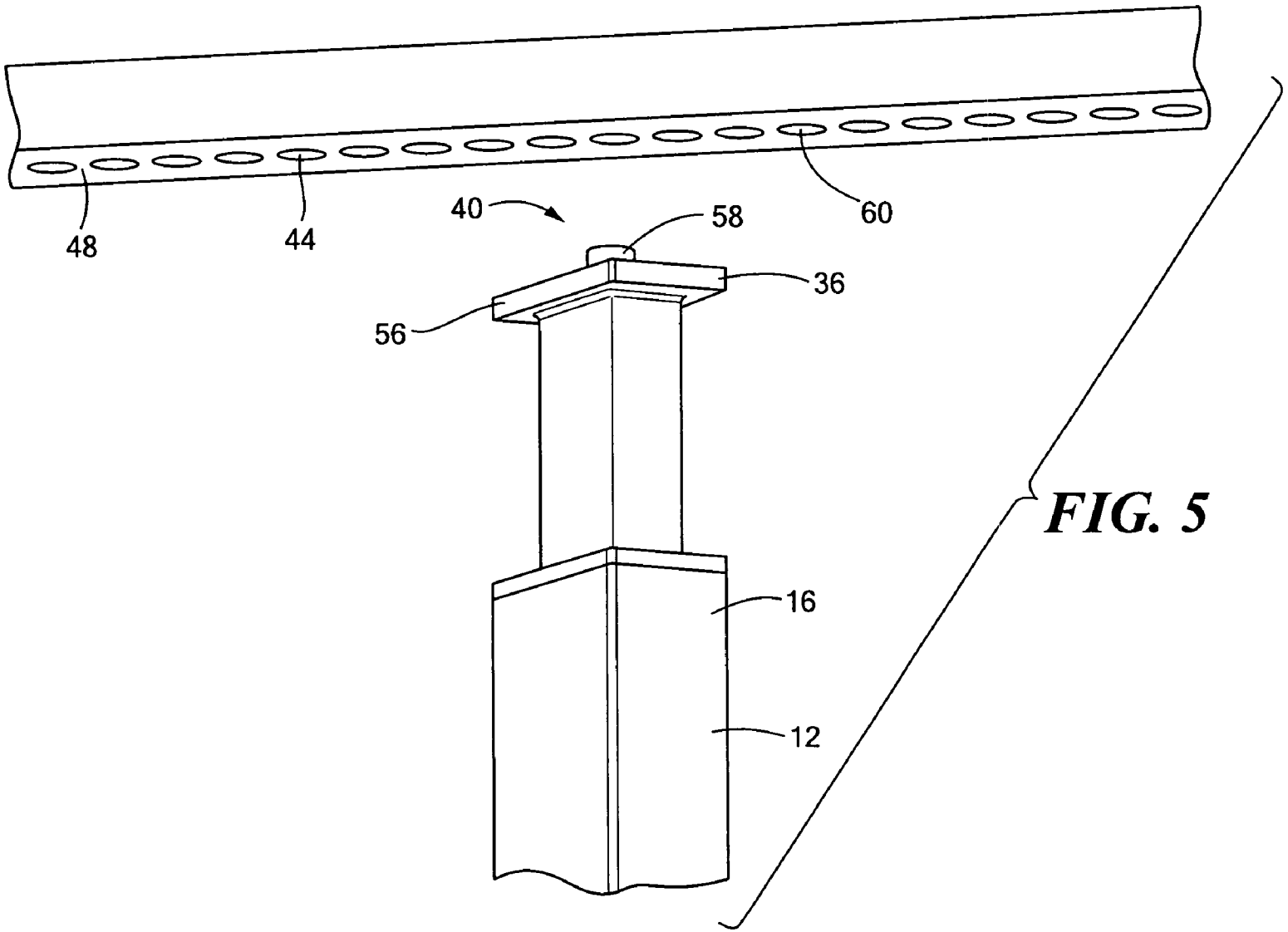
FIG. 5 is an exploded view of the upper end of the stanchion assembly of FIG. 1 and corresponding fitting on a ceiling.

Referring to FIGS. 4 and 5, the first or lower end cap 34 is provided on the lower end 14 of the beam 12. The second or upper end cap 36 is provided on the upper end 16 of the beam 12. Each end cap has a fitting 38, 40 thereon to mate with a corresponding fitting 42, 44 on a grid assembly 46 on a deck or floor and a grid assembly 48 on a ceiling of the cargo hold of a ship. In the embodiment illustrated, the lower end cap includes a plate 50 having two protrusions 52 extending therefrom that fit within corresponding openings 54 in the deck. The upper end cap includes a plate 56 having one protrusion 58 extending therefrom that fits within a corresponding opening 60 in the ceiling. Any configuration of mating fittings can be provided, as will be appreciated by those of skill in the art. For example, the fittings could include single or multiple protrusions, and the protrusions could be round or rectangular.

The lower end cap 34 is fixedly attached to the box beam in any suitable manner. For example, an insert or sleeve 64 is attached to the plate in a configuration that fits within the beam. See FIG. 2. Holes through the sleeve 64 and corresponding holes 66 through the flanges of the beam are aligned, and a pin 68 is inserted through the aligned holes to retain the end cap in place on the lower end of the beam. In another embodiment, the end cap can be welded to the lower end of the beam.

The upper end cap 36 is attached to the beam via a biasing assembly or spring assembly 70 for mounting the stanchion assembly in place in the cargo hold and retaining the stanchion assembly in place once mounted. The spring assembly is disposed within the elongated beam and configured to bias the upper end cap longitudinally outwardly of the beam. In this manner, the spring assembly retains the beam in a vertical position with the lower end cap within the corresponding fitting on the grid assembly on the floor and the upper end cap within the corresponding fitting on the grid assembly on the ceiling. Any suitable spring assembly can be used.

In the embodiment shown, the spring assembly 70 includes an insert or sleeve 72 fixed within the upper end of the box beam in any suitable manner. A plunger 74, to which the end cap 36 is fixed, is reciprocally movable within the sleeve. A compression spring (not shown) within the sleeve biases the plunger upwardly out of the box beam. The spring connects to a rod 80 that terminates with an end piece 84. In an uncompressed position, the rod end piece is located at an upper end of a slot 86 in the flange of the beam, or a pair of slots on opposed flanges of the beam. A dowel 88 inserted through the slots and the aperture in the end piece allows a user to draw the plunger into the sleeve in the beam against the bias of the spring. In this manner, the stanchion assembly length can be shortened sufficiently to allow the stanchion to be aligned with a fitting in the ceiling. Any desired spring travel can be accommodated, for example, six inches. Similarly any suitable spring constant can be accommodated, depending on the design requirements. Slot covers 92 and spacers 94 are preferably provided to close the slots and to keep the rod and end piece aligned within the beam. The moving elements can be lined with a friction-reducing material, such as DELRIN® or high density polyethylene (HDPE) to reduce friction and wear over the life of the stanchion. Alternatively or additionally, materials with good fire resistance properties can be used. The materials of the spring assembly can be a metal such as aluminum, a thermoplastic material such as glass-fiber-filled PEEK, or another composite material, as determined by the design and cost issues.

It will be appreciated that the biasing assembly or spring assembly could be integrated with the lower end cap rather than the upper end cap. In this case, the upper end cap could be fixed to the upper end of the beam as described above with respect to the lower end cap.

When setting a stanchion assembly, a user grasps the beam using the gripping edges and inserts the lower end cap into a corresponding fitting on the deck grid. The dowel is inserted and pulled downwardly against the bias of the spring assembly, thereby lowering the upper end cap a sufficient distance to align the upper end of the stanchion with a corresponding fitting on the ceiling grid. The stanchion balance point can also be marked during production for the user's reference. Once aligned, the spring assembly is allowed to bias the upper end cap upwardly into mating engagement with the ceiling grid. If desired, wedges can be inserted between the cargo and the stanchion assembly to further ensure that the cargo does not move.

The invention is not to be limited by what has been particularly shown and described, except as indicated by the appended claims.

What is claimed is:

1. A stanchion assembly for retaining cargo in a hold from lateral motion, the hold having a deck grid fitting assembly and a ceiling grid fitting assembly, the stanchion assembly comprising:

an elongated beam extending in a longitudinal direction from a lower end to an upper end, the beam comprising a box cross section comprising two parallel webs extending longitudinally and two parallel flanges extending longitudinally and connecting the two parallel webs, the beam further comprising an extrusion, the extrusion comprised of an aluminum or aluminum alloy;

wherein ends of the webs of the beam overhang the flanges, whereby gripping or attachment edges are provided;

a lower end cap on the lower end and an upper end cap on the upper end, the lower end cap having a fitting thereon to mate with a corresponding fitting on a grid assembly on a deck, the upper end cap having a fitting thereon to mate with a corresponding fitting on a grid assembly on a ceiling;

a spring assembly disposed within the elongated box beam and configured to bias one of the lower end cap or the upper end cap longitudinally outwardly of the beam, wherein the spring assembly retains the beam in a vertical position with the lower end cap within the corresponding fitting on the grid assembly on the deck and the upper end cap within the corresponding fitting on the grid assembly on the ceiling;

the stanchion assembly having a weight no greater than 67 pounds;

the stanchion assembly having a length L in the longitudinal direction from the lower end cap to the upper end cap when the spring assembly is uncompressed; and the beam having a stiffness capable of resisting a design load applied to one of the webs normal to the longitudinal direction with a deflection no greater than L/90.

2. The stanchion assembly of claim 1, wherein the web ends overhang the flanges by up to one inch.

3. The stanchion assembly of claim 1, wherein the length L is from 7 to 12 feet.

4. The stanchion assembly of claim 1, wherein the aluminum or aluminum alloy is anodized.

5. The stanchion assembly of claim 1, wherein the lower end cap fitting comprises at least one protrusion extending therefrom.

6. The stanchion assembly of claim 1, wherein the upper end cap fitting comprises at least one protrusion extending therefrom.

7. The stanchion assembly of claim 1, wherein the lower end cap is fixed to the lower end of the beam.

8. The stanchion assembly of claim 1, wherein the upper end cap is fixed to the upper end of the beam.

9. The stanchion assembly of claim 1, wherein the spring assembly is disposed within the beam to bias the upper end cap longitudinally outwardly of the beam.

10. The stanchion assembly of claim 1, wherein the spring assembly is disposed within the beam to bias the lower end cap longitudinally outwardly of the beam.

11. The stanchion assembly of claim 1, wherein the beam has a strength capable of resisting a load of twice the design load without permanent deformation from yielding.

* * * * *